United States Patent [19]

Levy

[11] Patent Number: 5,047,786

[45] Date of Patent: Sep. 10, 1991

[54] ELECTRIC HEATING APPARATUS UTILIZING DUAL CHAMBERS FOR HEATING BY CONVECTION

[75] Inventor: Pierre Levy, Rueil Malmaison, France

[73] Assignee: Airelec Industries, Cedex, France

[21] Appl. No.: 473,070

[22] Filed: Jan. 31, 1990

[30] Foreign Application Priority Data

Feb. 14, 1989 [FR] France ..... 89 01897

[51] Int. Cl.[5] ..... F24H 3/00

[52] U.S. Cl. ..... 392/370; 392/347; 392/353; 392/370; 165/53

[58] Field of Search ..... 219/365–370, 219/377, 354, 374–375, 342; 165/53–55; 392/375, 376, 378, 370, 352, 353, 347

[56] References Cited

U.S. PATENT DOCUMENTS

| | | | |
|---|---|---|---|
| 1,688,168 | 10/1928 | Whittaker | 219/365 |
| 2,552,837 | 4/1949 | Blazer | 219/366 |
| 3,051,816 | 4/1959 | Knoll et al. | 219/365 |
| 3,510,940 | 5/1970 | Orr | 219/611 |

FOREIGN PATENT DOCUMENTS

| | | | |
|---|---|---|---|
| 738865 | 7/1966 | Canada | 165/55 |
| 797359 | 10/1968 | Canada | 219/377 |
| 2026549 | 11/1970 | Fed. Rep. of Germany . | |
| 2940927 | 4/1980 | Fed. Rep. of Germany . | |
| 2574168 | 11/1984 | France . | |
| 95748 | 1/1966 | Norway | 219/367 |
| 885919 | 1/1962 | United Kingdom | 219/377 |

*Primary Examiner*—Bruce A. Reynolds
*Assistant Examiner*—John A. Jeffery
*Attorney, Agent, or Firm*—Sughrue, Mion, Zinn, Macpeak & Seas

[57] ABSTRACT

Electric heating apparatus having at least one electrical heating resistor (24) arranged in a body (1) of sheet metal provided with an air inlet in its lower part and an air outlet in its upper part. The body (1) is formed by a double-walled hollow element in the form of a trough (2, 3) provided with end walls (14, 15) and at least one opening (12) for the entry of air and defining a first space (20) for the admission of air. The electrical resistor (24) is mounted on the concave part of the double-walled element in the form of a trough (2, 3) on the exterior of the latter. A perforated panel (30) is arranged on the concave wall and defines with the latter a second space (33) for the heating of the air by convection and for the direct radiation of the heat by the resistor through the perforations in the perforated panel. At least one opening (35, 36) is made in the hollow element (2, 3) in order to put the first and second spaces (20, 33) in communication, and at least one passage (31c) for the discharge of hot air is provided between the hollow element (2, 3) and a lateral edge of the perforated panel (30).

12 Claims, 3 Drawing Sheets

ELECTRIC HEATING APPARATUS UTILIZING DUAL CHAMBERS FOR HEATING BY CONVECTION

The present invention relates to electric heating apparatuses and relates more particularly to heating apparatuses comprising electrical resistors with heat dissipation fins.

Electric convection heating apparatuses are known, also called convectors, comprising one or more electrical heating resistors arranged in a body of sheet metal defining a circulation path for the air in contact with the heating resistor(s), from an air inlet situated in the lower part of the body to an air outlet situated in the upper part of the said body.

The electrical resistors of such convectors are fed with electric current from the mains via thermostatic means likewise arranged in the body of the apparatus.

Likewise known are radiant electric heating apparatuses whose electrical resistors become red-hot when fed.

The electrical resistors are arranged in front of a surface which reflects the radiation in such a way that the heat emitted by the resistors is projected into the room.

There likewise exist heating apparatuses in the form of radiant panels, generally formed by plates of enamelled sheet iron to which the electrical heating resistors are applied.

A disadvantage of the known heating apparatuses resides in the fact that they are of significant bulk, particularly in surface area, such that their installation on a wall of a room takes up a considerable space.

Moreover, by the very fact of their significant bulk, traditional convectors are relatively unaesthetic.

With regard to apparatuses employing visible radiation, it is difficult to use them in domestic premises by reason, in particular, of the danger represented by their visible resistors brought to red heat The invention aims to remedy the disadvantages of the known electric heating apparatuses by creating an electric heating apparatus which, while having an improved aesthetic appearance, has an increased heating capacity and a reduced volume.

The invention relates to an electric heating apparatus comprising at least one electrical heating resistor arranged in a body of sheet metal provided with an air inlet in its lower part and an air outlet in its upper part, characterized in that the body is formed by a double-walled hollow element in the form of a trough provided with end walls and at least one opening for the entry of air and defining a first space for the admission of air, in that the electrical resistor is mounted on the concave part of the double-walled element in the form of a trough on the exterior of the latter, a perforated panel being arranged on the said concave wall and defining with the latter a second space for the heating of the air by convection and for the direct radiation of the heat by the resistor through the perforations in the perforated panel, at least one opening being made in the said hollow element in order to put the first and second spaces in communication and at least one passage for the discharge of hot air being provided between the hollow element and a lateral edge of the perforated panel.

According to a particular characteristic of the invention, the double-walled hollow element is formed by a baseplate provided with means for fixing to a wall, a piece of metallic sectional material provided with two end plates fixed to the baseplate and, together with the baseplate, defining the first space for the admission of air, the electrical resistor being mounted on the opposite face of the piece of sectional material to the said first space, the perforated resistor-protection panel fixed to the piece of sectional material defining, together with that portion of the piece of sectional material to which it is fixed, the second space for the heating of the air by convection and for the direct radiation of the heat by the resistor through its perforations, the first space being put in communication with the outside via at least one first opening made in a lower part of the piece of sectional material, while the second space is put in communication with the first space by at least one second opening made in a wall of the piece of sectional material ensuring the separation of the said first and second spaces, and the second space is put in communication with the outside by at least one passage provided between a lateral flange of the perforated panel and a wing of the piece of sectional material.

The invention will be better understood with the aid of the description which follows, given solely by way of example and with reference to the attached drawings, in which.

Figure 1:
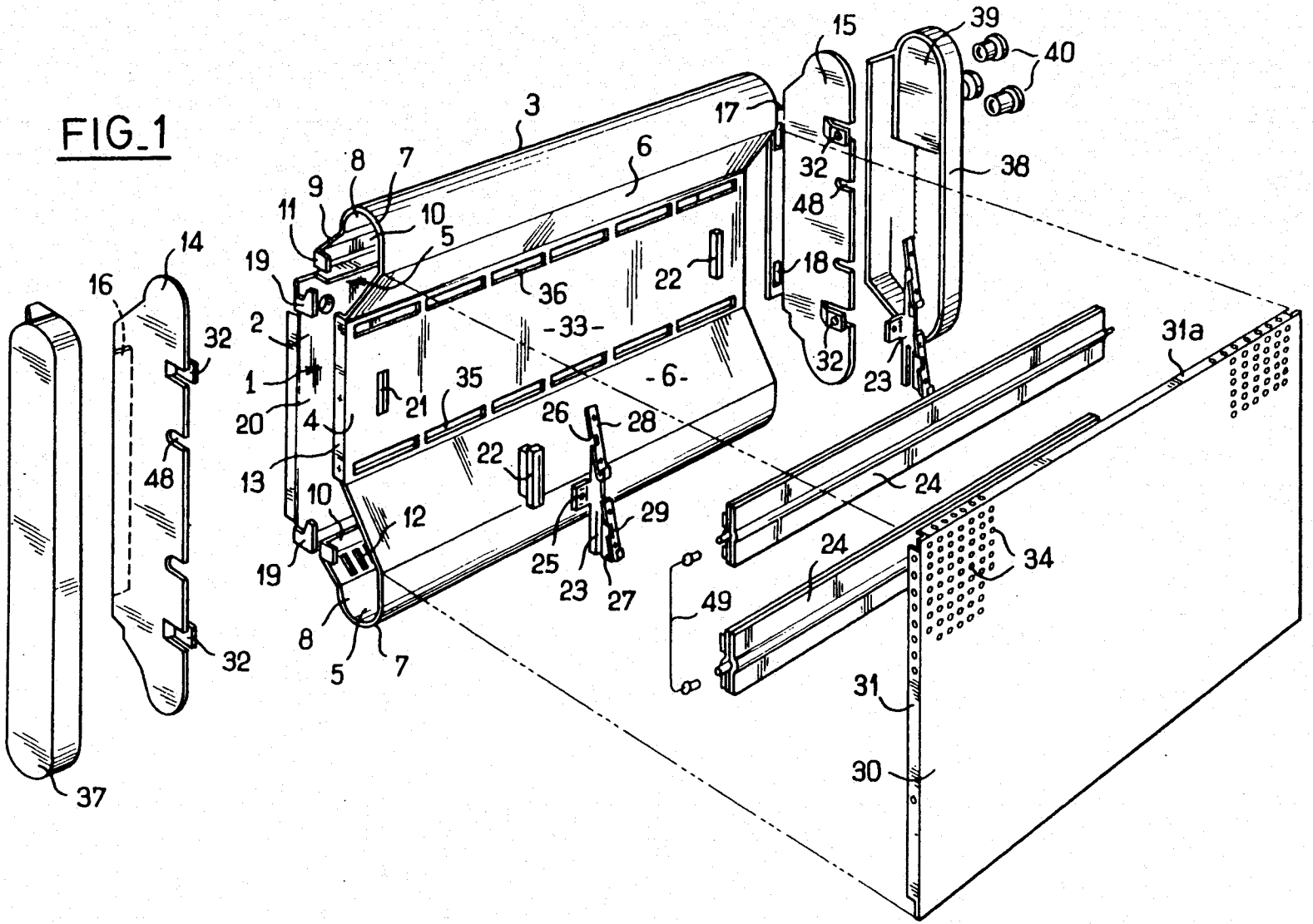
FIG. 1 is an exploded perspective view of an electric heating apparatus according to the invention.

The electric heating apparatus shown in FIG. 1 principally comprises a body designated by the general reference 1, this body being formed by a double-walled hollow element in the form of a trough, comprising a baseplate 2 formed by a metal plate having the general form of a rectangle, designed to be fixed to the wall of premises to be equipped with the apparatus according to the invention and on which is fixed a piece 3 which forms the principle element of the apparatus and is formed by a piece of sectional material comprising a flat rectangular web 4 and two lateral wings 5.

Each of the lateral wings 5 comprises a first part 6 inclined relative to the web 4 and diverging from the latter, a second part 7 prolonging the first part 6 and folded back behind the web 4 to form a lateral channel 8, the second part 7 being, in turn, prolonged by an approximately flat third part 9 extending parallel to the corresponding first part 6.

The third part 9 is terminated by a flange 10 parallel to the web 4 and provided at its ends with tabs 11 folded back towards the interior.

In the third, inclined part 9 of the wing 5 designed to form the lower part of the body 1 are arranged rectangular orifices 12 for the admission of fresh air.

Flanges 13 for fixing end plates 14 and 15, for example by welding, to the piece of sectional material are provided at the ends of the web 4 of the piece of sectional material 3. The tabs 11 provided at the ends of the flanges 10 of the third parts 9 of each of the wings 5 are likewise provided in order to form points for fixing these same plates by welding.

Each of the plates 14 and 15 has an inward-turned flange 16, 17, folded back at right angles, intended for insertion between the flanges 10 of the piece of sectional material 3 and provided with holes 18 for receiving hooks 19 for the removable fixing of the piece of sectional material 3, fitted with its end plates 14, 15, on the baseplate 2.

The baseplate 2 and the piece of sectional material 3 fitted with its plates 14 and 15 define a first space 20 for the admission of air into the body 1 of the apparatus. Rectangular orifices 21 intended to receive insulating pieces 22 for fixing supports 23 for heating resistors 24 are arranged in the web 4.

The electrical heating resistors 24 are fixed on the web 4 of the piece of sectional material 3 on the opposite side from the first space 20 for the admission of fresh air into the body 1 of the apparatus.

The resistor supports 23 are formed by metallic pieces permitting expansion. Each of the supports 23 comprises a connector 25, by which it is fixed on the insulating piece 22, and two arms 26 and 27 extending upwards and downwards, respectively, having flexibility transversely to their direction and provided with inclined surfaces 28 and 29, respectively, for receiving each of the resistors 24.

Once mounted, the resistors 24 are thus inclined slightly upwards, this permitting the radiated heat to be directed more towards the center of the room to be heated.

The body 1 of the apparatus is completed by a front panel 30 made of perforated sheet metal and provided with end flanges 31 by which it is fixed to the piece of sectional material 3 equipped with its end plates 14 and 15 by engagement of these end flanges 31 on hooks 32 formed by localized cutting and folding of the sheet metal of the plates 14 and 15.

Figure 3:
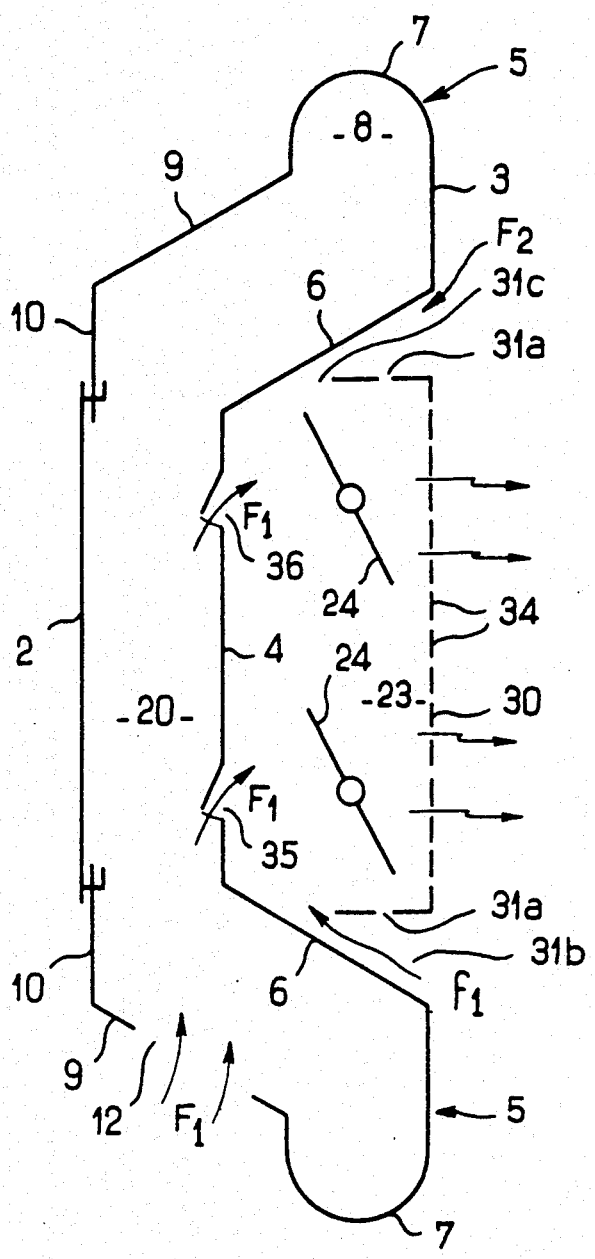
FIG. 3 is a schematic view, in cross-section, of the heating apparatus according to the invention.

The front panel 30 likewise comprises lateral flanges 31*a* provided with perforations and defining, together with the first parts 6 of the wings 5 of the piece of sectional material, a lower passage 31*b* for the entry of fresh air and an upper passage 31*c* for the exit of hot air (FIG. 3).

The front panel 30 serves as a protection panel for the resistors 24 and, together with the portion of the piece of sectional material 3 which it covers and the end plates 14 and 15, defines a second space 33 for the heating of the air on contact with the electrical heating resistors 24 and for discharging this heated air via the passage 31*c* defined between the lateral flange 31*a* and the first part 6 of the upper wing 5 of the piece of sectional material.

The communication of the first space 20 for the admission of fresh air with the second space 33 for heating and discharging the hot air is ensured by two series of openings 35, 36 arranged in the lower part and in the upper part of the web 4 of the piece of sectional material.

The orifices 36 arranged in the upper part of the web 4 are in addition intended for the admission of relatively fresh air to the upper part of the body 1 of the apparatus in order to avoid excessive heating of the wall of the latter.

The function of the perforations 34 in the front panel 30 is to allow the passage of the radiant heat emitted by the electrical heating resistors 24.

The electric heating apparatus according to the invention is completed by end cheeks 37, 38 of an electrically and thermally insulating material, for example of plastic material, covering the end plates 14 and 15, respectively, and hiding the joints of the latter with the piece of sectional material 3.

The end cheek 38 furthermore receives a control assembly comprising a thermostat, a temperature limiter and all the necessary electrical equipment. This electrical assembly is designated by the reference 39. Control buttons 40 are mounted on the cheek 38 carrying the electrical assembly 39.

Figure 2:
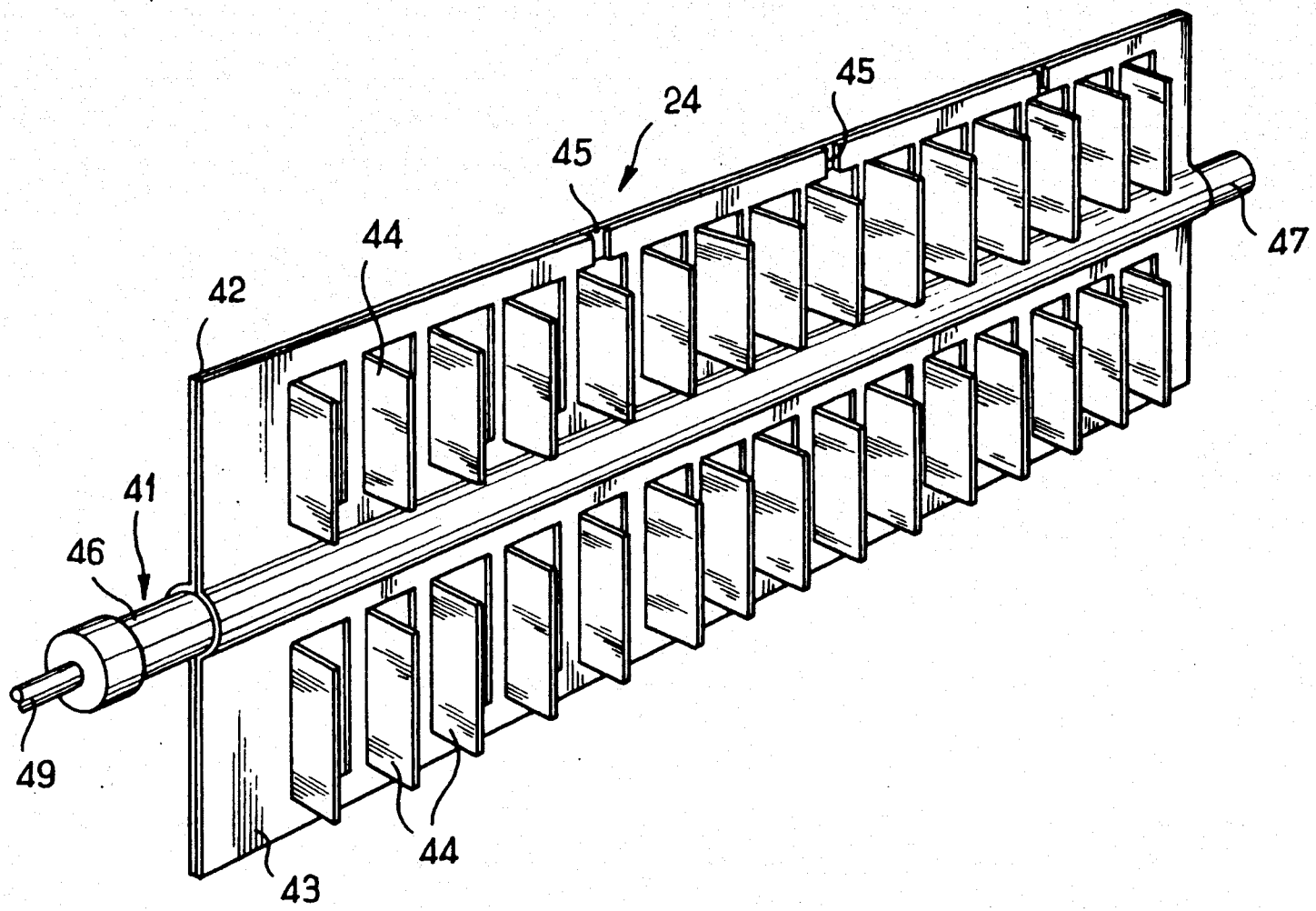
FIG. 2 is a perspective view of a particular embodiment of electrical resistor used in the apparatus of FIG. 1.

The two electrical heating resistors 24 are shielded electrical resistors. One of these resistors is represented in greater detail in FIG. 2.

This is an electrical resistor placed in a metallic tube 41 contained between a flat plate 42 facing the front panel 30 of the apparatus and a perforated plate 43 provided with fins 44 made in the said plate by cutting and folding at 90°, these fins being directed towards the web 4 of the piece of sectional material 3.

The plates 42 and 43 are advantageously made of aluminium. Furthermore, the plate 43 provided with folded-back fins 44 comprises interruptions 45 at regular intervals intended to avoid noise upon heating up.

Once the resistors 24 are mounted on their support 23, their terminals 46, 47 pass through indentations 48 arranged in the end plates 14, 15 and can be connected on the other side of these plates either to the mains or to each other, when the connection is a series connection, by controughors such as the controughor 49 represented in FIG. 1, which is hidden between the end plate 14 and the end cheek 37.

In the embodiment described with reference to FIG. 1, the lower resistor can have a higher rating than the upper resistor, this making it possible to have a constant surface temperature and, consequently well distributed radiation.

The functioning of the heating apparatus according to the invention will now be described with reference to FIG. 3.

The fresh air is admitted to the first space 20 via the series of openings 12 arranged in the lower wing 5 of the piece of sectional material 3 and circulates in this space to emerge from it via the orifices 35 and 36 in the direction indicated by the arrows F1 and penetrate into the second space 33 delimited by the web 4, the first parts 6 of the wings 5 of the piece of sectional material and the perforated panel 30.

A smaller quantity of ambient air simultaneously penetrates in accordance with arrow F1 into the second space 33 via the passage 31*b* provided between the lower lateral flange 31*a* of the perforated panel 30 and the first part 6 of the lower wing 5 of the piece of sectional material 3.

In the second space 33, the air is heated by convection on contact with the resistors 24, the plates 43 of which, provided with folded-back fins directed towards the web 4 of the piece of sectional material 3, favour convection.

Thus heated on contact with the resistors 24, the hot air is discharged towards the outside of the apparatus in accordance with arrow F2 via the passage 31*c* provided between the upper lateral flange 31*a* of the perforated panel 30 and the first part 6 of the upper wing 5 of the piece of sectional material 3.

In addition, the relatively fresh air which passes through the openings 36 arranged in the upper part of the web 4 of the piece of sectional material 3 mixes with the hotter air and thus prevents excessive heating of the upper part of the apparatus.

Furthermore, the heat radiated by the resistors 24 and, in particular, by their flat plates 42 turned towards the perforated panel passes directly to the outside of the apparatus through the perforations 34 of the panel 30.

The apparatus thus functions simultaneously by radiation and convection.

The apparatus according to the invention thus provides significant radiation towards the front and likewise dissipates heat by convection at the rear of the electrical resistors.

The fact that the principal element 3 of the apparatus is in the form of a piece of sectional material is very advantageous for making apparatuses of different lengths.

In fact, to modify the length of the apparatus, it is sufficient to select of a piece of sectional material 3 of appropriate length.

Of course, the baseplate 1 and the front panel 30 and the resistors 24 will have to be adapted to the new length of the piece of sectional material selected. However, all the other parts used for making the heating apparatus according to the invention will be identical to those described with reference to FIG. 1.

The presence of the covers 37 and 38 at the ends of the heating apparatus according to the invention and of their rounded form at the corners makes it possible to ensure the safety of the users.

In the embodiment which has just been described, shielded electrical resistors having a flat plate and a plate provided with folded-back fins are used.

However, resistors of different construction can be used in the apparatus, in particular resistors having flat plates on their two faces.

Figure 4:
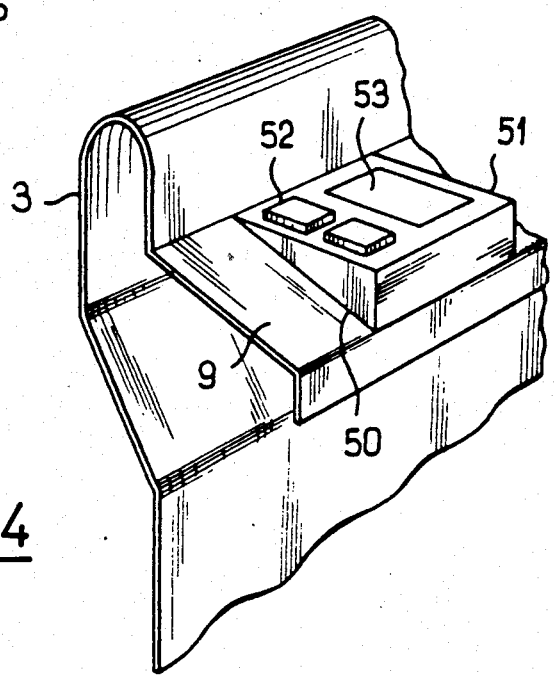
FIG. 4 is a partial schematic view, in perspective, of a variant of a piece of sectional material used in the construction of the heating apparatus according to the invention.

According to a variant represented in FIG. 4, a cut-out 50, for example rectangular, provided in the approximately flat third part 9 of the upper wing 5 of piece 3 is made in the piece 3 in the form of a piece of sectional material.

Mounted in the cut-out 50 is a housing 51 made of insulating material, such as plastic material, containing an electronic device having a microprocessor for programming the heating and provided with a keyboard 52 and a liquid crystal display 53.

The apparatus according to the invention furthermore has the advantage of being easily installed and removed.

Thus, the installation of the apparatus starts with the positioning of the baseplate 1 and is followed by simply hooking the rest of the apparatus onto the hooks 19 provided at the ends of the baseplate and appropriate locking.

Finally, by reason of its structure, the apparatus lends itself to a construction of low thickness, thus considerably improving its aesthetic qualities.

I claim:

1. Electric heating apparatus comprising at least one electrical heating resistor (24) arranged in a body (1) of sheet metal provided with an air inlet in its lower part and an air outlet in its upper part, characterized in that the body (1) is formed by a double-walled hollow element in the form of a trough (2, 3), provided with end walls (14, 15) and at least one opening (12) for the entry of fresh air and defining a first space (20) for the admission of air, in that the electrical resistor (24) is mounted on the concave part of the double-walled element in the form of a trough (2, 3) on the exterior of the latter, a perforated panel (30) being arranged on the said concave wall and defining with the latter a second space (33) for the heating of the air by convection and for the direct radiation of the heat by the resistor through the perforations in the perforated panel, at least one opening (35, 36) being made in the said hollow element (2, 3) in order to put the first and second spaces (20, 33) in communication and at least one passage (31*c*) for the discharge of hot air being provided between the hollow element (2, 3) and a lateral edge of the perforated panel (30).

2. Electric heating apparatus according to claim 1, characterized in that the double-walled hollow element is formed by a baseplate (2) provided with means for fixing to a wall, a piece of metallic sectional material (3) provided with two end plates (14, 15) fixed to the baseplate (2) and, together with the baseplate, defining the first space (20) for the admission of air, the electrical resistor (24) being mounted on the opposite face of the piece of sectional material (3) to the said first space (20), the perforated resistor-protection panel (30) fixed to the piece of sectional material (3) defining, together with that portion of the piece of sectional material to which it is fixed, the second space (33) for the heating of the air by convection and the direct radiation of the heat by the resistor through its perforations (34), the first space (20) being put in communication with the outside via at least one first opening (12) arranged in a lower part of the piece of sectional material, while the second space (33) is put in communication with the first space (20) by at least one second opening (35, 36) arranged in a wall of the piece of sectional material ensuring the separation of the said first and second spaces, and the second space (33) is put in communication with the outside by at least one passage (31*b*, 31*c*) for discharging hot air arranged between a lateral flange of the perforated panel (30) and a wing (5) of the piece of sectional material (3).

3. Electric heating apparatus according to claim 2, characterized in that the piece of sectional material (3) comprises a flat rectangular web (4), on which the said resistor (24) is fixed, and lateral wings (5) each comprising a first part (6) inclined relative to the web and diverging from the latter, a second part (7) prolonging the first part (6) and folded back behind the web (4) to form a lateral channel (8), the second part (7) being, in turn, prolonged by an approximately flat third part (9) extending parallel to the corresponding first part (6).

4. Electric heating apparatus according to claim 3, characterized in that the said opening for the entry of fresh air, of which there is at least one, is formed by a series of openings (12) arranged in the third part (9) of one of the wings (5) of the piece of sectional material (3).

5. Heating apparatus according to claim 3, characterized in that the said opening, of which there is at least one, for putting the first and second spaces (20, 33) in communication is formed by at least one series of openings (35) arranged in the lower part of the web (4) of the piece of sectional material

6. Electric heating apparatus according to claim 5, characterized in that at least one series of supplementary orifices (36) are arranged in the upper part of the web (4) of the piece of sectional material (3), these supplementary orifices furthermore being intended to prevent the excessive heating of the upper part of the body (1) of the apparatus.

7. Electric heating apparatus according to claim 6, characterized in that the said resistor (24), of which there is at least one, is mounted on the web (4) of the piece of sectional material via resistor supports (23)

fixed to the said web by means of insulating pieces (22) and provided with inclined supporting surfaces (28, 29) to provide the said resistor (24) with a slope from the bottom towards the top.

8. Electric heating apparatus according to claim 2, characterized in that it comprises cheeks of an electrically and thermally insulating material (37, 38) covering the end plates (14, 15) and hiding the joints of these plates with the piece of sectional material (3).

9. Heating apparatus according to claim 8, characterized in that one of the said cheeks (38) contains an electrical assembly (39) for controlling the apparatus and is provided with control buttons (40).

10. Heating apparatus according to claim 2, characterized in that the baseplate (2) is provided with hooks (19) cooperating with holes (18) for receiving the said hooks, provided in the inward-turned flanges (16, 17) of the end plates (14, 15), the said hooks (19) and the said holes (18) forming means for the detachable fixing of the piece of sectional material (3) fitted with its end plates (14, 15) on the baseplate (2).

11. Heating apparatus according to claim 3, characterized in that the said electrical resistor (24), of which there is at least one, is a shielded resistor comprising a tube (41) which contains the resistor proper and is contained between a flat plate (42) and a perforated plate (43) provided with fins (44) obtained by cutting and folding, the flat plate (42) being located in front of the perforated panel (30) and the perforated plate (43) provided with fins (44) being located in front of the web (4) of the piece of sectional material.

12. Heating apparatus according to any one of claims 2 to 11, characterized in that it furthermore comprises an electronic device having a microprocessor for programming the heating comprising a keyboard (52) and a display (53), mounted in a housing (51) made of insulating material arranged in a cut-out (50) made in a wing (5) of the piece of metallic sectional material (3).

* * * * *